US005887285A

United States Patent [19]

McCormick

[11] Patent Number: 5,887,285

[45] Date of Patent: Mar. 30, 1999

[54] INSULATED LINER FOR HEADGEAR

[75] Inventor: Bruce McCormick, Houston, Tex.

[73] Assignee: Polar Wrap, LLC, Houston, Tex.

[21] Appl. No.: 925,570

[22] Filed: Sep. 8, 1997

[51] Int. Cl.[6] ..... A42C 5/00

[52] U.S. Cl. ..... 2/181.4; 2/181; 2/171.1

[58] Field of Search ..... 2/181, 181.2, 181.4, 2/171.1

[56] References Cited

U.S. PATENT DOCUMENTS 4,949,404 8/1990 Fekete, Sr. .
4,951,319 8/1990 Phillips, Jr. et al. .
4,951,320 8/1990 Yoon .
5,025,504 6/1991 Bensten et al. .
5,054,122 10/1991 Sher .

*Primary Examiner*—Diana L. Biefeld
*Attorney, Agent, or Firm*—Reising, Ethington, Learman & McCulloch

[57] ABSTRACT

A headgear assembly including a flexible cap and an insulator adapted to increase the heat retention of the cap. The cap includes an interior surface and a peripheral edge which surround and define a hemispherical interior cavity. A sweatband is affixed to the peripheral edge of the cap and is located adjacent the interior surface of the cap. The insulator is disposed within the interior cavity of the cap and includes a peripheral edge disposed between the band and the interior surface of the cap which retains the insulator within the cap.

9 Claims, 1 Drawing Sheet

INSULATED LINER FOR HEADGEAR

TECHNICAL FIELD

The present invention relates to an insulated liner for use with headgear for increasing the heat retention of the headgear.

BACKGROUND ART

Typical caps, such as baseball caps, are not well adapted for cold weather use. In fact, these caps are designed to provide air flow over the head to increase cooling. Many other types of headgear not specifically designed for cold weather are also ill suited for heat retention.

Prior art devices have sought to provide insulation for caps and hats to improve the comfort and heat retention of the headgear. One such device is disclosed in U.S. Pat. No. 4,949,404 issued to Fekete, Sr. on Aug. 21, 1990. The device comprises an insulating member including stretchable woven tubes which fit tightly about the user's head. However, the device is not well suited for a cap or similar headgear because it can not be removably retained by a cap and is too thick to comfortably fit between the cap and the user's head.

SUMMARY OF THE INVENTION

In accordance with this invention, a headgear assembly is provided including a head covering having an interior surface, a peripheral edge, and an interior cavity defined by said interior surface and said peripheral edge. A band is affixed to the interior surface of the head covering adjacent the peripheral edge, and an insulator is removably received within the interior cavity of the head covering having a peripheral edge disposed between the band and the interior surface of the head covering.

The invention also provides an insulator adapted for use with headgear to increase the heat retention of the headgear. The insulator includes at least one panel forming a generally dome-shaped structure with the panel including at least one layer of insulation and at least one layer of covering fabric secured to the layer of insulation. The layer of covering fabric is water-resistant.

By providing an insulator which can be removably retained within headgear, the subject invention permits a user to selectively control the level of heat retention of the headgear. Further, by providing an insulator with a water-resistant layer of covering fabric, the insulator provides further comfort and protection for a user against rain or other moisture which may pass through the headgear.

PREFERRED EMBODIMENT OF THE INVENTION

Figure 1:
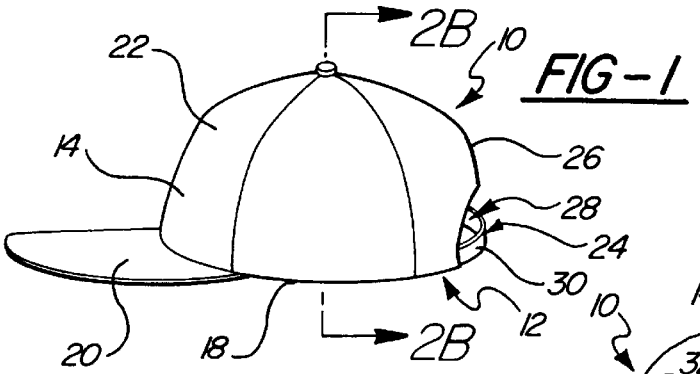
FIG. 1 is a side view of a typical adjustable cap.

The present invention comprises a headgear assembly shown generally at 10 in FIG. 1. In the preferred embodiment, the headgear assembly includes a cap 12, such as a typical baseball-style cap, which is dome-shaped and includes a exterior surface 14, an interior surface 16, and a peripheral edge 18. A bill 20 is attached to the peripheral edge 18 adjacent a front portion 22 of the cap 12, and an adjustment means 24 is attached to the cap 12 adjacent a back portion 26 of the cap 12. The adjustment means 24 permits the size of the cap 12 to be adjusted to varying head sizes.

The back portion 26 has a generally semicircular cut-out region 28 which is associated with the adjustment means 24. The adjustment means 24 comprises an adjustable band 30 attached to opposing sides 32,34 of the semicircular cut-out region 28 adjacent the peripheral edge 18 of the cap 12. Typically, the adjustable band 30 comprises a pair of straps 36 which can be pulled together to tighten the cap 12 and then secured together by a snaps 38, a clip (not shown), or other means. The adjustable band 30 can also comprise a single elastic band (not shown) or any other suitable device which allows the user to adjust the size of the cap 12.

Figure 2A:
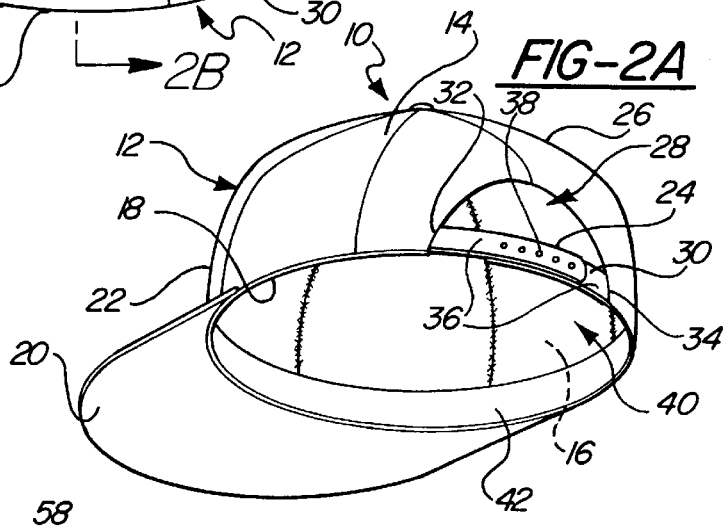
FIG. 2A is a perspective view of a cap insulator removably attached between the band and the interior of the cap.
Figure 2B:
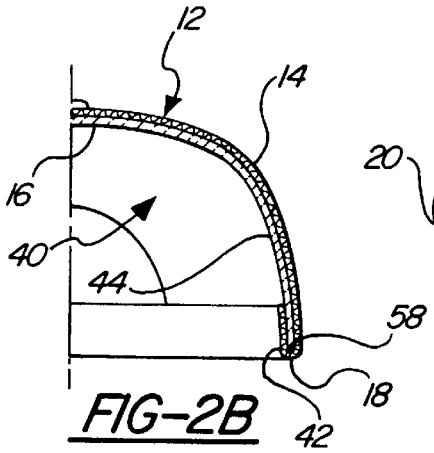
FIG. 2B is a cross sectional view of the cap with a cap insulator removably attached between the band and the interior of the cap taken along the line 2—2 of FIG. 1.

As best shown in FIGS. 2A and 2B, the interior surface 16 and peripheral edge 18 of the cap 12 define an interior cavity 40 which is adapted to engage the crown of the user's head (not shown) when the cap 12 is worn. The cap 12 also includes a sweatband 42 disposed adjacent the interior surface 16 of the cap 12 for absorbing perspiration from a user. The sweatband 42 extends along the peripheral edge 18 of the cap 12 from one side 32 of the semi-circular cut-out region 28 to an opposing side 34 of the cut-out region 28. Typically the sweatband 42 is sewn to the peripheral edge 18 of the cap 12.

Although not shown in the Figures, the present invention can also incorporate a fitted, non-adjustable cap which does not include the adjustment device or cut-out region described in FIG. 2A. With a fitted cap, the sweatband is attached to the entire perimeter of the cap.

Figure 3:
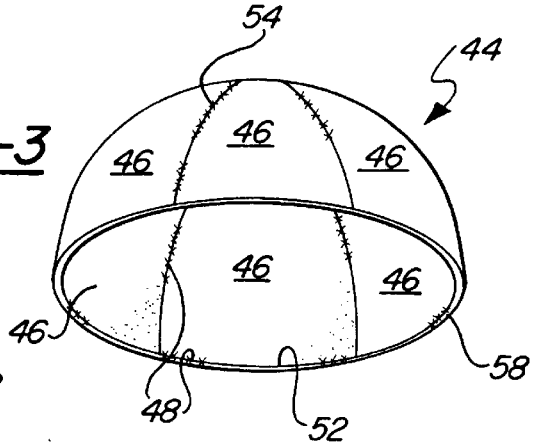
FIG. 3 is a perspective view of cap insulator.
Figure 4:
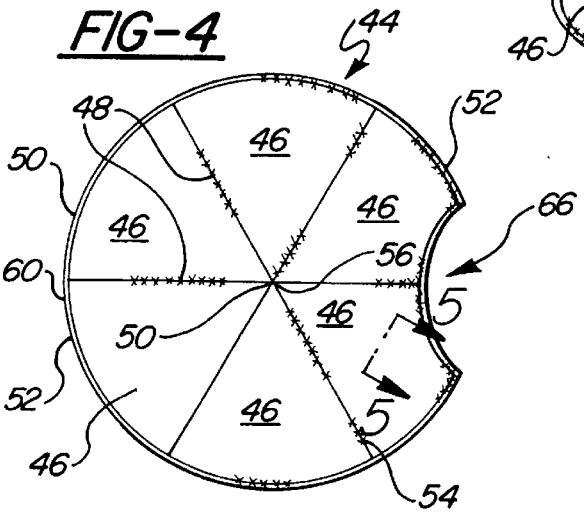
FIG. 4 is a top view of a cap insulator with a generally semicircular opening.

As shown in FIGS. 3 and 4, a hemispherical insulator 44 is provided which is adapted to be received within the interior cavity 40 of the cap 12 to improve the heat-retention characteristics of the cap 12. In the preferred embodiment, the insulator 44 utilizes a plurality of panels 46, namely six, affixed to one another to form a dome-shaped structure. Any number of panels 46 may be used as long as the hemispherical shape of the insulator 44 is maintained and the construction of the insulator 44 is not unduly complex or costly.

The panels 46 are generally triangular in shape with each panel 46 having two sides 48 coming to an apex 50 and having an arcuate bottom edge 52. The sides 48 of the triangular panels 46 are sewn together by stitching 54 such that the apexes 50 meet at the center 56 of the insulator 44. Alternatively, the panels 46 may be glued together or attached by any suitable means. The arcuate bottom edges 52 of the triangular panels 46 form a peripheral edge 58 of the insulator 44. For added reinforcement, a fabric band 60 may sewn around the peripheral edge 58 of the insulator 44 or the peripheral edge 58 may be sewn flat.

Figure 5:
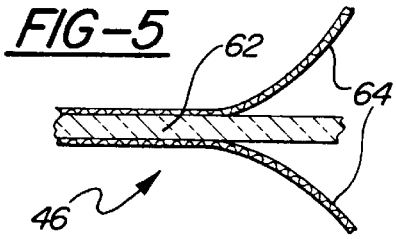
FIG. 5 is a cross sectional view of the cap insulator taken along line 5—5 in FIG. 4.

Each panel 46 of the insulator 44 is constructed of at least one layer of insulation 62 and at least one layer of covering fabric 64. In the preferred embodiment shown in FIG. 5, a single layer of insulation 62 is sandwiched between two layers of covering fabric 64. The insulation 62 may be composed of any material that has a high "R value," i.e. high heat retention capability. One preferred insulating material is manufactured by du Pont under the tradename "Hollofil." Suitable covering fabrics include permeable materials such as nylon or cotton or, as in the preferred embodiment, semi-permeable materials such as "Gore-Tex." Semi-permeable materials such as "Gore-Tex" provide a comfortable, breathable, waterproof barrier while still retaining the heat radiated from the user's head. The layers of insulation 62 and covering fabric 64 are joined together by stitching although any other suitable means of attachment is acceptable.

To retain the insulator 44 within the interior cavity 40 of the cap 12, the peripheral edge 58 of the insulator 44 is disposed between the sweatband 42 and the interior surface 16 of the cap 12 as illustrated in FIG. 2B. This configuration permits easy installation and removal of the insulator 44 without any unnecessarily complex attachment mechanisms. As shown in FIG. 4, the insulator 44 includes a semicircular cut-out region 66 corresponding to the cut-out region 28 in the back portion of the cap 12. For fitted, non-adjustable caps (not shown in the Figures), the insulator does include the semicircular cut-out region.

When installing the insulator 44 into the cap 12, the sweatband 42 is folded down away from the interior surface 16 of the cap 12 and the insulator 44 is inserted within the interior cavity 40. The sweatband 42 is then folded back to its original position such that the peripheral edge 58 of the insulator 44 is disposed between the sweatband 42 and the interior surface 16 of the cap 12. If an insulator 44 is being used in conjunction with an adjustable cap 12, the semicircular cut-out region 66 of the insulator 44 is aligned with the semicircular cut-out region 28 in the cap 12. After the insulator 44 has been installed, the heat retention of the cap 12 is greatly increased and the insulated cap 12 may then be worn by the user. To remove the insulator 44, the sweatband 42 is again folded down away from the interior surface 16 of the cap 12 and the insulator 44 is separated from the cap 12.

The invention has been described in an illustrative manner, and it is to be understood that the terminology which has been used is intended to be in the nature of description rather than limitation.

Obviously, many modifications and variations of the present invention are possible in the light of the above teachings. It is to be understood, therefore, that within the scope of the appended claims the invention may be practiced otherwise than as specifically described.

What is claimed is:

1. A headgear assembly comprising:

a head covering having an interior surface, a peripheral edge, and an interior cavity defined by said interior surface and said peripheral edge;

a band affixed to said interior surface of said head covering adjacent said peripheral edge; and an insulator removably received within said interior cavity of said head covering and having a peripheral edge disposed between said band and said interior surface of said head covering;

said insulator comprising at least one panel forming a generally dome-shaped structure and said panel including at least one layer of insulation and at least one layer of covering fabric secured to said layer of insulation; and said layer of covering fabric being water-resistant.

2. The headgear assembly of claim 1 wherein said layer of covering fabric is air permeable.

3. The headgear assembly of claim 1 wherein said layer of covering fabric is substantially waterproof.

4. The headgear assembly of claim 1 wherein said insulator comprises six panels and each said panel includes at least one layer of insulation and at least one layer of covering fabric.

5. The headgear assembly of claim 1 wherein said at least one panel includes one layer of insulation sandwiched between two layers of covering fabric.

6. A headgear assembly comprising:

a flexible cap having an interior surface, a peripheral edge, and an interior cavity defined by said interior surface and said peripheral edge;

a band affixed to said interior surface of said flexible cap adjacent said peripheral edge; and a dome-shaped flexible insulator removably received within said interior cavity of said flexible cap and having a peripheral edge disposed between said band and said interior surface of said flexible cap.

7. The headgear assembly of claim 6 wherein said band is made from an absorbent material.

8. A headgear assembly comprising:

a cap having an interior surface, a peripheral edge, and an interior cavity defined by said interior surface and said peripheral edge;

a band affixed to said interior surface of said cap adjacent said peripheral edge; and an insulator removably received within said interior cavity of said cap and having a peripheral edge disposed between said band and said interior surface of said cap;

said cap including a back portion with a semicircular cut-out region;

said cap including adjustment means attached to opposing sides of said cut-out region for adjusting the size of said cap; and said insulator including a semicircular cut-out region generally aligned with said semicircular cut-out region in said cap.

9. A headgear assembly comprising:

a head covering having an interior surface, a peripheral edge, and an interior cavity defined by said interior surface and said peripheral edge;

a band affixed to said interior surface of said head covering adjacent said peripheral edge; and an insulator removably received within said interior cavity of said head covering and having a peripheral edge disposed between said band and said interior surface of said head covering, wherein said insulator includes a second band joined to said peripheral edge thereof.

* * * * *